US009758297B2

(12) United States Patent
Chen et al.

(10) Patent No.: US 9,758,297 B2
(45) Date of Patent: Sep. 12, 2017

(54) ADJUSTABLE TILTING PACKAGING BOX FOR LIQUID CRYSTAL MODULE

(71) Applicant: Shenzhen China Star Optoelectronics Technology Co., Ltd., Shenzhen, Guangdong (CN)

(72) Inventors: Shihhsiang Chen, Shenzhen (CN); Jiahe Cheng, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 1023 days.

(21) Appl. No.: 14/007,648

(22) PCT Filed: Aug. 1, 2013

(86) PCT No.: PCT/CN2013/080633

§ 371 (c)(1),
(2) Date: Sep. 25, 2013

(87) PCT Pub. No.: WO2015/013955

PCT Pub. Date: Feb. 5, 2015

(65) Prior Publication Data

US 2016/0355326 A1 Dec. 8, 2016

(30) Foreign Application Priority Data

Jul. 29, 2013 (CN) ..... 2013 1 0323109

(51) Int. Cl.
*B65D 85/48* (2006.01)
*B65D 85/30* (2006.01)

(52) U.S. Cl.
CPC ..... *B65D 85/48* (2013.01); *B65D 85/30* (2013.01); *B65D 2585/86* (2013.01)

(58) Field of Classification Search
CPC ..... B65D 85/48; B65D 85/30; B65D 2585/86
(Continued)

(56) References Cited

U.S. PATENT DOCUMENTS 1,859,401 A * 5/1932 Lengsfield ..... B65D 5/5213 206/751
4,136,773 A * 1/1979 Booth ..... A45C 11/34 206/214

(Continued)

FOREIGN PATENT DOCUMENTS

CN 1780772 A 5/2006

*Primary Examiner* — Chun Cheung
(74) *Attorney, Agent, or Firm* — Andrew C. Cheng

(57) ABSTRACT

The invention provides an adjustable tilting packaging box for liquid crystal module. The first solution includes: box, support rack for carrying liquid crystal module, supporting rack being connected to box bottom through first support element. First support element includes at least a first adjustment mechanism, connected to side of support rack; wherein, first adjustment mechanism including: a first support pillar, a resilient element and a positioning element. First support pillar is retractably connected to box bottom through resilient element; first support pillar is disposed with resilient buckle matching positioning element to realize multi-level rising and lowering of first support pillar. Through tilt angle of support rack making PCB located at lower end of leaning, the weight of PCB prevents PCB from folding up to cause crease in COF or damage to glass during bumpy transportation. The invention uses another means of angle adjustment mechanism to achieve same objective.

4 Claims, 3 Drawing Sheets

(58) Field of Classification Search
USPC ..... 206/736–744, 756–766, 255, 454, 762, 206/761, 765; 248/371, 133, 574; 220/558, 8
See application file for complete search history.

(56) References Cited

U.S. PATENT DOCUMENTS 4,519,498 A * 5/1985 Booth ..... A45C 11/34 206/214
7,273,240 B2 * 9/2007 Migli ..... E05C 19/022 292/251.5
8,210,380 B2 * 7/2012 Jin ..... B65F 1/02 206/761
9,207,040 B2 * 12/2015 Bushee ..... F21V 33/0076

* cited by examiner

ADJUSTABLE TILTING PACKAGING BOX FOR LIQUID CRYSTAL MODULE

BACKGROUND OF THE INVENTION

1. Field of the Invention

The present invention relates to the field of liquid crystal displaying techniques, and in particular to a packaging box for liquid crystal module.

2. The Related Arts

The manufacturing and transport process includes: transporting open cell to the TV or display manufacturers for assembly, wherein the open cells must be packaged before transportation. As shown in FIG. 1 and FIG. 2, the known packaging box includes: paper box, plastic box, and so on. The liquid crystal module 20 and buffering material are stacked in a interleaving manner into a box 10. As shown in the figures, the open cell 23 is connected to chip on film (COF) 21 and printed circuit board (PCB) 22. The bumpy transportation may cause crease in COF 21 or the PCB 22 to move under the open cell 22. With additional vibration, the PCB 22 and the open cell 20 may be scratched to degrade the quality of the product. To solve the above problem, some boxes will include convex platform to separate PCB 22 and open cell 23. However, during normal access, occasional scratches on the PCB 22 may still occur due to the convex platform and cause damages to the COF 21 or other internal parts and lower the yield rate.

SUMMARY OF THE INVENTION

The technical issue to be addressed by the present invention is to overcome the above problem through suitable adjustment of the angle of placement when placing liquid crystal module to avoid the shift of the PCB during transportation to lower the yield rate.

The present invention provides an adjustable tilting packaging box for liquid crystal module, which comprises: a box, wherein further comprising: support rack, for carrying the liquid crystal module, the supporting rack being connected to the bottom of the box through first support element; the first support element comprising at least a first adjustment mechanism, connected to a side of the support rack and being resilient and adjustable; wherein, the first adjustment mechanism comprising: a first support pillar, a resilient element and a positioning element; wherein the first support pillar being retractably connected to the bottom of the box through the resilient element; the first support pillar being disposed with a resilient buckle matching the positioning element to realize the multi-level rising and lowering of the first support pillar; through the height adjustment of an end of the support rack, the open cell being placed at a specific angle and the weight of PCB preventing shifting during transportation.

According to a preferred embodiment of the present invention, one end of the first support pillar is connected to a side of the support rack in a hinged manner, and the other end is connected to the resilient element; wherein the resilient element is a spring.

According to a preferred embodiment of the present invention, the first adjustment mechanism further comprises a first support pillar stop element, wherein the first support pillar stop element is fixed to the bottom of the box, disposed with an opening for inserting the first support pillar at the top; the first support pillar is disposed with an engaging ring at the lower end, and the engaging ring is smaller than the opening and is confined inside the first support pillar stop element.

According to a preferred embodiment of the present invention, the resilient buckle comprises a spring and a buckle element fixedly connected to one end of the spring; the other end of the spring is fixedly connected to the first support pillar through a via hole disposed on the first support pillar; wherein the buckle element extends partially beyond the first support pillar, the extending part forms a slope shape, comprising a downward slope and an upward flat surface.

According to a preferred embodiment of the present invention, the positioning element comprises a multi-level positioning board; the positioning board is disposed with positioning hole; the first support pillar passes through the positioning hole; wherein the positioning hole has a diameter smaller than the combined size of the first support pillar and the extending part of the buckle element.

The present invention provides an adjustable tilting packaging box for liquid crystal module, which comprises: a box, wherein further comprising: support rack, for carrying the liquid crystal module, the supporting rack being connected to the bottom of the box through second support element; the second support element comprising at least a second adjustment mechanism, connected to a side of the support rack and height-adjustable; wherein, the second adjustment mechanism comprising: a second support pillar and a pull rod; wherein one end of the pull rod penetrating a hole disposed at a side of the box and extending to outside of the box, and the other end being disposed with a plurality of levels corresponding to the lower end of the second support pillar; through the retraction of the pull rod and the attachment of the second support pillar, the multi-level rising and lowering of the second support element being realized; through the height adjustment of an end of the support rack, the open cell being placed at a specific angle and the weight of PCB preventing shifting during transportation.

According to a preferred embodiment of the present invention, the second adjustment mechanism further comprises a second support pillar stop element, wherein the second support pillar stop element is disposed with stop hole corresponding to the second support pillar; the lower end of the first support pillar extends into the hole and the upper end of the second support pillar is connected to a side of the support rack in a hinged manner.

According to a preferred embodiment of the present invention, the first level, which is relatively higher than the remaining levels, is disposed at the outer end of the pull rod, when the second support pillar and the first level are attached to support, the inner wall of the lower end of the second support pillar stop element is disposed with a stop position to stop the first level.

According to a preferred embodiment of the present invention, the second adjustment mechanism further comprises a restoration spring, disposed between the side of the first level and the second support pillar stop element, for applying an outward push to the pull rod.

According to a preferred embodiment of the present invention, the attachment surfaces between the second support pillar and the levels are parallel slope surfaces wherein the slope surface of the level at the outer end is leaning downward towards the end.

The efficacy of the present invention is that to be distinguished from the state of the art. Through adjusting the placement angle of placing liquid crystal module to make the PCB located at an end of a lower end of a leaning surface, the weight of PCB prevents the PCB from folding up to cause crease in COF or damage to the glass during bumpy transportation. The packaging box avoids damages causing lower yield rate. Also, when in storage or during manufacturing, the packaging box can be adjusted to horizontal level to facilitate manufacturing.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The following description refers to the embodiments and drawings of the present invention.

First Embodiment

Figure 1:
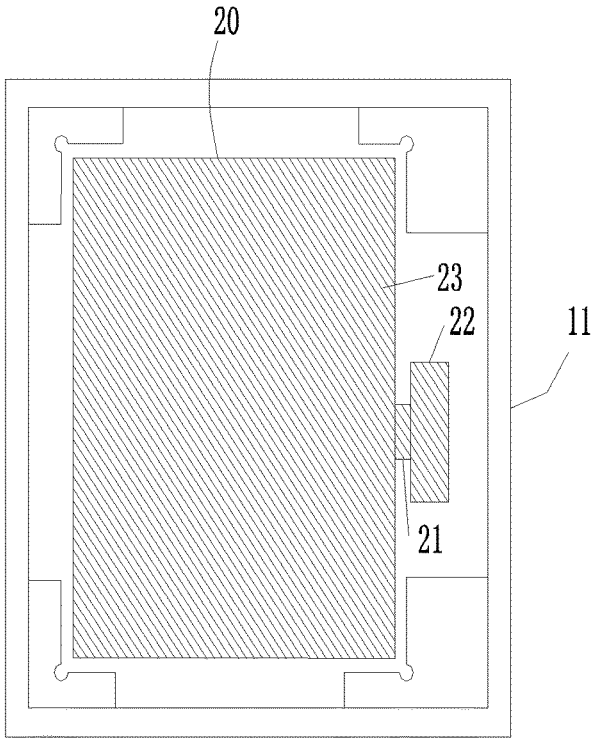
Figure 1 (Prior Art)
FIG. 1 is a schematic top view showing the liquid crystal module in a known packaging box.
Figure 2:
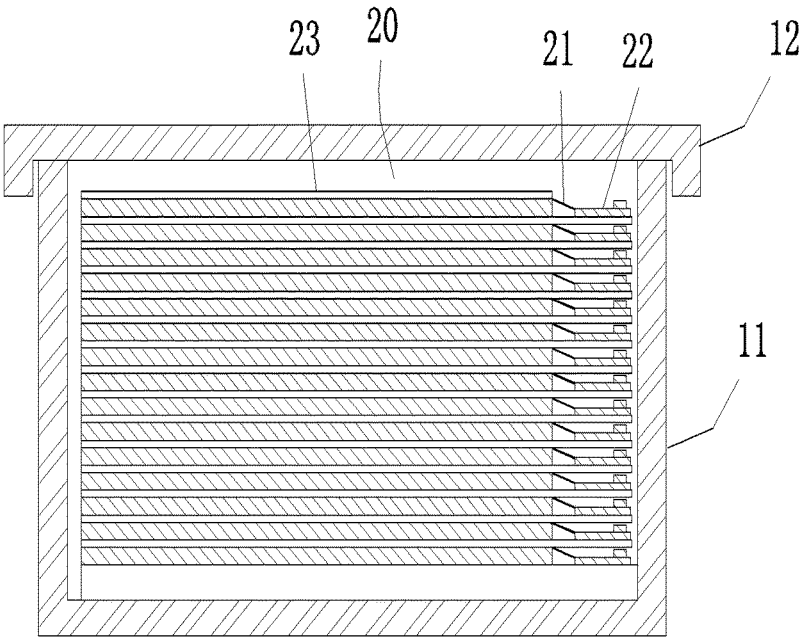
Figure 2 (Prior Art)
FIG. 2 is a schematic view showing the stacking of the liquid crystal modules in a known packaging box.
Figure 3:
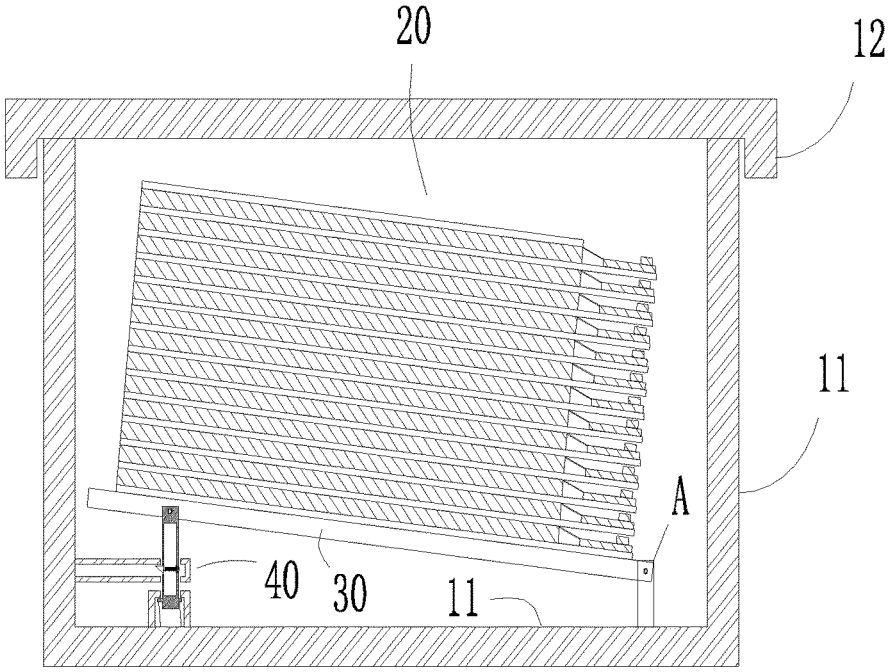
FIG. 3 is a schematic view showing the stacking of the liquid crystal modules in a packaging box according to the first embodiment of the present invention.
Figure 4:
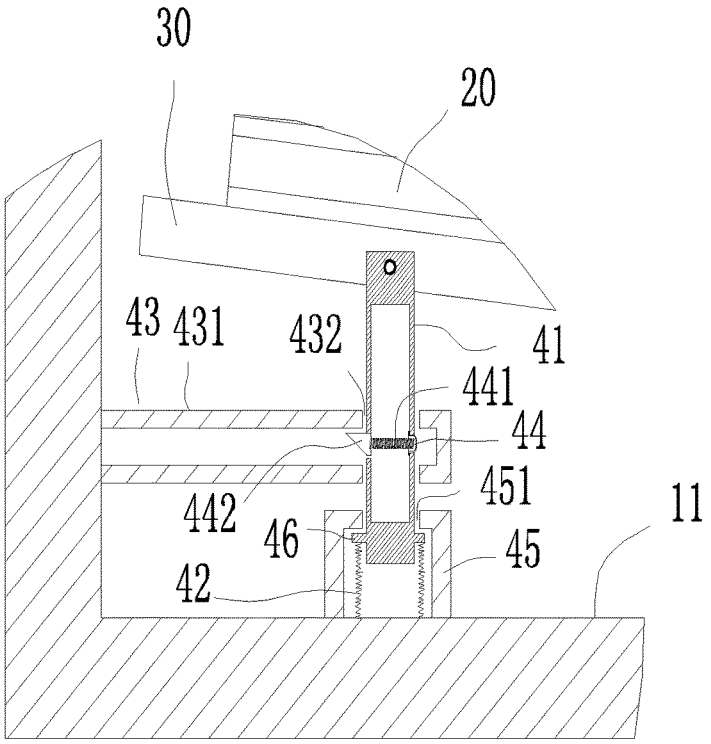
FIG. 4 is a schematic view showing the structure of the first support element according to the first embodiment of the present invention.

As shown in FIG. 3 and FIG. 4, the adjustable tilting packaging box for liquid crystal module comprises a box 10 and an upper lid 12. The liquid crystal modules 20 are stacked and loaded on the support rack 30. The support rack 30 is connected to the bottom 11 of the box 10 through the first support element. As shown in the figures, first support element comprises two sets. One end of a set is fixed to the bottom 11 of the box 10 and the other end is connected to the support rack 30 in a hinged manner, shown as A in the figure. The other set is connected to the other side of the support rack 30, and is a resilient adjustable first adjustment mechanism 40, wherein the first adjustment mechanism comprises a first support pillar 41, a resilient element 42 and a positioning element 43. The first support pillar 41 is retractably connected to the bottom 11 of the box 10 through the resilient element 42. The first support pillar 41 is disposed with a resilient buckle 44 matching the positioning element 43 to realize the multi-level rising and lowering of the first support element. The following will describe each component in details.

One end of the first support pillar 41 is connected to a side of the support rack 30 in a hinged manner, and the other end is connected to the resilient element 42. In the instant embodiment, the resilient element 42 is a spring, which is to apply an upward force to the first support pillar 41. Also to fix the position of the first support pillar 41, a first support pillar stop element 45 is disposed. The first support pillar stop element 45 is fixed to the bottom 11 of the box 10. The top of the first support pillar stop element 45 is disposed with an opening 451 for inserting the first support pillar 41. The lower end of the first support pillar 41 is disposed with an engaging ring 46. The engaging ring 46 is smaller than the opening 451 and is confined inside the first support pillar stop element 45. As such, the two ends of the first support pillar 41 are correspondingly fixed or stopped, and the first support pillar 41 can only move up and down within a specific range. The resilient buckle 44 comprises a spring 441 and a buckle element 442 fixedly connected to one end of the spring 441; the other end of the spring 441 is fixedly connected to the first support pillar 41 through a via hole 47 disposed on the first support pillar 41. The buckle element 442 extends partially beyond the first support pillar 41. The extending part forms a slope shape, comprising a downward slope and an upward flat. Also referring to the positioning element 43, the positioning element 43 comprises a multi-level positioning board 431. In the instant embodiment, the number of levels is two. The positioning board 431 is disposed with positioning hole 432. The first support pillar 41 passes through the positioning hole 432, wherein the positioning hole 432 has a diameter smaller than the combined size of the first support pillar 41 and the extending part of the buckle element 442. As such, the first support pillar 41 disposed with a buckle element 442 can only move in one direction.

Also referring to FIG. 4, under the effect of the spring, a push is applied to the first support pillar 41. On the other hand, under the effect of the buckle element 442 and positioning board 431, the first support pillar 41 is fixed to the position. After stacking liquid crystal modules on the support rack 30, under the effect of the spring force, the first adjustment mechanism 40 is at a raised position higher than the first support element at the other side of the support rack. The test shows that a tilt at 5°-15° of the support rack can effectively prevent the crease occurrence in COF during transporting liquid crystal modules. Of course, the tilt is made by the raise of the first adjustment mechanism. Fine tuning of tilt for accommodating different transportation environment can be achieved by additional gaps added to the multi-level positioning board 431 and adjusting the gap of the multi-level positioning board 431.

For resetting, a tool can be used to press the buckle element 442 back into the first support pillar 41. As such, the first support pillar 41 can move vertically inside the positioning hole 432.

The Second Embodiment

Figure 5:
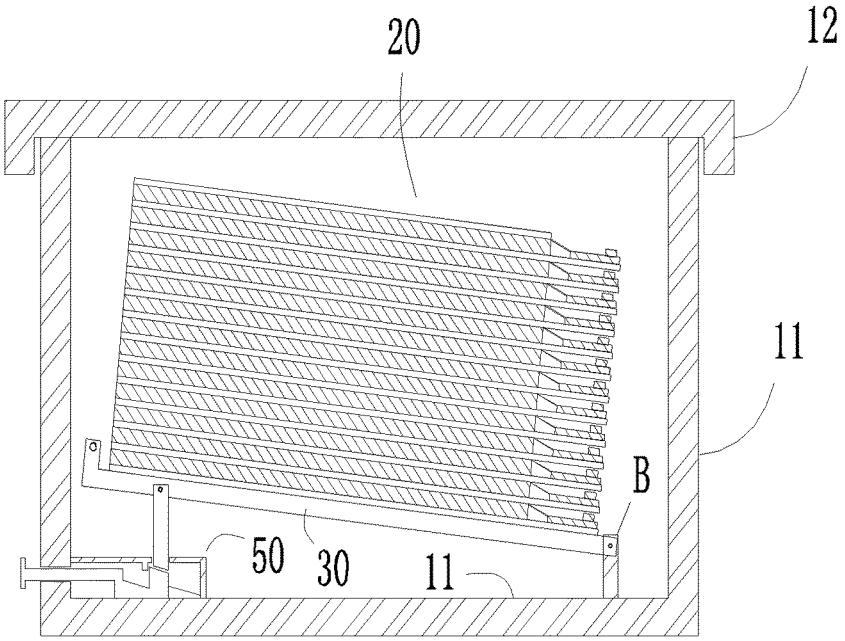
FIG. 5 is a schematic view showing the stacking of the liquid crystal modules in a packaging box according to the second embodiment of the present invention.
Figure 6:
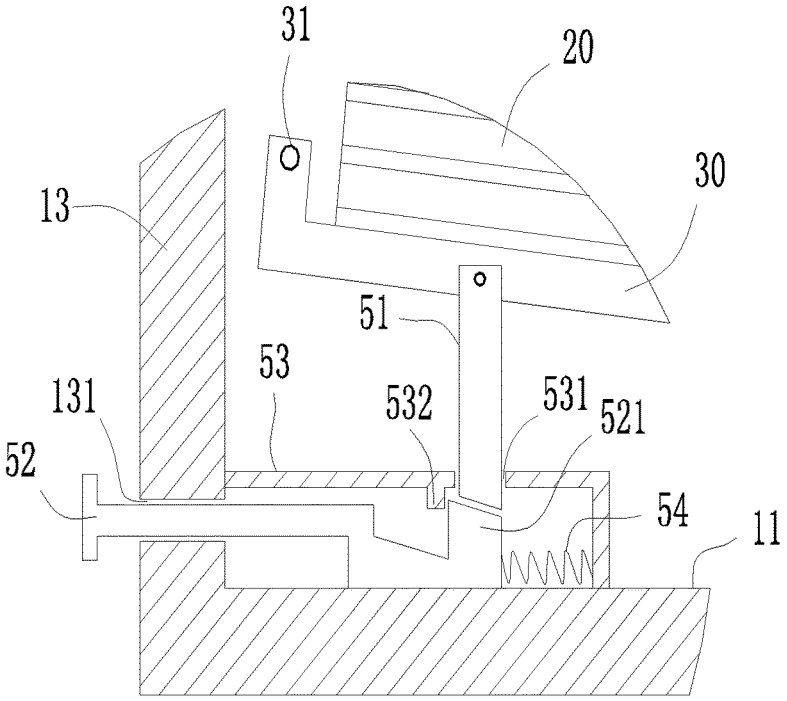
FIG. 6 is a schematic view showing the structure of the second support element according to the first embodiment of the present invention.

The instant embodiment is shown in FIG. 5 and FIG. 6. The adjustable tilting packaging box for liquid crystal module comprises a box 10 and an upper lid 12. The liquid crystal modules 20 are stacked and loaded on the support rack 30. The support rack 30 is connected to the bottom 11 of the box 10 through the second support element. As shown in the figures, second support element comprises two sets. One end of a set is fixed to the bottom 11 of the box 10 and the other end is connected to the support rack 30 in a hinged manner, shown as B in the figure. The difference is that the other set is connected to the other side of the support rack 30, and is a height-adjustable second adjustment mechanism 50; wherein the second adjustment mechanism 50 comprises a second support pillar 51 and a pull rod 52. One end of the pull rod 52 penetrates a hole 131 disposed at a side 13 of the box 10 and extending to outside of the box 10, and the other end of the pull rod 52 is disposed with a plurality of levels corresponding to the lower end of the second support pillar 51. Through the retraction of the pull rod 52 and the attachment of the second support pillar 51, the multi-level rising and lowering of the second support element is realized. The following will describe each component in details.

As shown in the figures, the second adjustment mechanism 50 further comprises a second support pillar stop element 53, wherein the second support pillar stop element 53 is disposed with stop hole 531 corresponding to the second support pillar 51. The lower end of the first support pillar 51 extends into the hole 531 and the upper end of the second support pillar 51 is connected to a side of the support rack 30 in a hinged manner for limiting the second support pillar 51 to move upwards and downwards. The first level 521, which is relatively higher than the remaining levels, is disposed at the outer end of the pull rod 52. When the second support pillar 51 and the first level 521 are attached to support, the inner wall of the lower end of the second support pillar stop element 53 is disposed with a stop position 532 to stop the first level 521. To apply an outward push to the pull rod 52, the instant embodiment further comprises a restoration spring 54, disposed between the side of the first level 521 of the pull rod 52 and the second support pillar stop element 53. The attachment surfaces between the second support pillar 51 and the levels are parallel slope surfaces wherein the slope surface of the level at the outer end is leaning downward towards the end.

Also referring to FIG. 6, when the second support pillar 51 is raised, the pull rod 52 can extend and retract in a horizontal direction, that is, to left and right. The stop position 532 further restricts the possibility of the pull rod 52 from further pull out completely. When the pull rod 52 is not under any external force, the restoration spring 54 applies a outward push to the pull rod 52. As such, when the second support pillar 51 is lowered, the second support pillar 51 will attach to the slope surfaces. If the raised height of the second support pillar 51 is to be lowered, the support rack 30 is raised first, and then a pull hook 31 extending from a side of the support rack 30 can be raised, followed by pushing in the pull rod 52 inwards and finally, the support rack 30 is lowered. As such, the second support pillar 51 will attach to the top surface of the next level so as to achieve the lowering of the second adjustment mechanism 50. The slope adjustment extent can refer to the first embodiment.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. An adjustable tilting packaging box for liquid crystal module, which comprises: a box, wherein further comprising:

a support rack, for carrying the liquid crystal module, the supporting rack being connected to the bottom of the box through first support element; and the first support element comprising at least a first adjustment mechanism, connected to a side of the support rack and being resilient and adjustable; wherein, the first adjustment mechanism comprising: a first support pillar, a resilient element and a positioning element; wherein the first support pillar being retractably connected to the bottom of the box through the resilient element; the first support pillar being disposed with a resilient buckle matching the positioning element to realize the multi-level rising and lowering of the first support pillar;

wherein one end of the first support pillar is connected to a side of the support rack in a hinged manner, and the other end is connected to the resilient element; the resilient element is a spring.

2. The packaging box for liquid crystal module as claimed in claim 1, wherein the first adjustment mechanism further comprises a first support pillar stop element, wherein the first support pillar stop element is fixed to the bottom of the box, disposed with an opening for inserting the first support pillar at the top; the first support pillar is disposed with an engaging ring at the lower end, and the engaging ring is smaller than the opening and is confined inside the first support pillar stop element.

3. The packaging box for liquid crystal module as claimed in claim 1, wherein the resilient buckle comprises a spring and a buckle element fixedly connected to one end of the spring; the other end of the spring is fixedly connected to the first support pillar through a via hole disposed on the first support pillar; wherein the buckle element extends partially beyond the first support pillar, the extending part forms a slope shape, comprising a downward slope and an upward flat surface.

4. The packaging box for liquid crystal module as claimed in claim 3, wherein the positioning element comprises a multi-level positioning board; the positioning board is disposed with positioning hole; the first support pillar passes through the positioning hole; wherein the positioning hole has a diameter smaller than the combined size of the first support pillar and the extending part of the buckle element.

* * * * *